US007225962B2

(12) United States Patent
Porth et al.

(10) Patent No.: US 7,225,962 B2
(45) Date of Patent: Jun. 5, 2007

(54) NAIL ADVANCEMENT SYSTEMS FOR NAIL ARRAYS DISPOSED WITHIN NAILING TOOL MAGAZINES

(75) Inventors: Chris H. Porth, Gurnee, IL (US); Larry M. Moeller, Mundelein, IL (US); Barry C. Walthall, Wheeling, IL (US); Clayton O. Henry, Waukegan, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/060,864

(22) Filed: Feb. 18, 2005

(65) Prior Publication Data

US 2006/0186171 A1 Aug. 24, 2006

(51) Int. Cl.
*B25C 1/04* (2006.01)
*B25C 5/10* (2006.01)
*B25C 1/16* (2006.01)

(52) U.S. Cl. ..... 227/136; 227/109; 227/119; 227/135; 227/137

(58) Field of Classification Search ..... 227/135, 227/136, 120, 109, 123, 137, 119, 106
See application file for complete search history.

(56) References Cited

U.S. PATENT DOCUMENTS 3,261,526 A 7/1966 Novak
3,524,576 A * 8/1970 Bader ..... 227/136
RE27,101 E 3/1971 Maynard
3,708,097 A * 1/1973 Fisher ..... 227/136
3,826,419 A * 7/1974 Maestri ..... 227/136
3,945,551 A * 3/1976 Sato et al. ..... 227/136
4,442,965 A * 4/1984 Leistner ..... 227/136
4,553,688 A 11/1985 Furutsu
4,593,845 A 6/1986 Andersson et al.
4,784,308 A 11/1988 Novak et al.
4,858,812 A 8/1989 Fealey
4,942,996 A 7/1990 Wolfberg et al.
5,240,161 A * 8/1993 Kaneko ..... 227/109
5,273,200 A 12/1993 Hoefler
5,332,141 A 7/1994 Mukoyama et al.
5,339,983 A 8/1994 Caple
5,558,264 A 9/1996 Weinstein
5,683,024 A * 11/1997 Eminger et al. ..... 227/8
5,738,266 A 4/1998 Ogawa
5,772,098 A 6/1998 Crutcher
5,799,856 A 9/1998 Mukoyama
5,829,661 A 11/1998 Hirtl et al.
5,904,285 A 5/1999 Anderson et al.

(Continued)

FOREIGN PATENT DOCUMENTS

EP 0 321 440 6/1989

(Continued)

*Primary Examiner*—Rinaldi I. Rada
*Assistant Examiner*—Nathaniel Chukwurah
(74) *Attorney, Agent, or Firm*—Schwartz & Weinrieb

(57) ABSTRACT

Fastener-advancement systems comprise a multiple lever and linkage mechanically operated system operatively connected to the driver blade member of the fastener driving tool, as well as electro-mechanically operated systems, for advancing a leading fastener of a collated strip of fasteners into the driver blade channel of the fastener-driving tool. In the electro-mechanically operated systems, push-type, pull-type, and rotary solenoid actuating members are utilized for moving the fastener-advancement feed pawl or claw member.

20 Claims, 7 Drawing Sheets

U.S. PATENT DOCUMENTS

| | | | | |
|---|---|---|---|---|
| 6,006,975 | A | 12/1999 | Ishizawa | |
| 6,027,004 | A | 2/2000 | Ramella et al. | |
| 6,041,992 | A * | 3/2000 | Poinelli et al. | 227/130 |
| 6,109,146 | A | 8/2000 | Muro | |
| 6,170,730 | B1 * | 1/2001 | Lin | 227/119 |
| 6,308,880 | B1 * | 10/2001 | Ronconi | 227/119 |
| 6,363,818 | B1 | 4/2002 | Habermehl | |
| 6,499,642 | B1 | 12/2002 | Amada | |
| 6,598,777 | B2 | 7/2003 | Osuga et al. | |
| 6,626,345 | B2 | 9/2003 | Amada | |
| 6,655,572 | B2 | 12/2003 | Amada | |
| 6,688,510 | B2 | 2/2004 | Amada | |
| 6,708,861 | B2 | 3/2004 | Osuga et al. | |

FOREIGN PATENT DOCUMENTS

| | | |
|---|---|---|
| EP | 0 349 163 | 1/1990 |
| GB | 1 438 264 | 6/1976 |
| JP | 54 136478 | 12/1979 |

* cited by examiner

NAIL ADVANCEMENT SYSTEMS FOR NAIL ARRAYS DISPOSED WITHIN NAILING TOOL MAGAZINES

FIELD OF THE INVENTION

The present invention relates generally to nailing tools, and more particularly to new and improved nail advancement systems for advancing the leading nail fastener of a collated strip or collated array of nail fasteners so as to position the leading nail fastener of the collated strip or array of nail fasteners along the drive axis of the nailing tool such that the driver member can drive and discharge the leading nail fastener out from the nailing tool and into an underlying substrate.

BACKGROUND OF THE INVENTION

In combustion-powered, fastener-driving tools, a combustible fuel is injected into a combustion chamber and mixed with air so as to define a combustible mixture which, upon being ignited, serves to drive a driving piston to which there is fixedly mounted a fastener-driving member. The fastener-driving member is accordingly driven along an axial path, at which the leading nail fastener, of a collated strip or collated array of nail fasteners, has been predisposed, from its retracted position to its extended position so as to drive and discharge the leading nail fastener, of the collated strip or collated array of fasteners, out from the nailing tool and into an underlying substrate. In order to cyclically advance the leading nail fastener of the collated strip or array of fasteners, so as to predispose the leading nail fastener, of the collated strip or array of fasteners, along the axial drive path of the fastener-driving member, such combustion-powered, fastener-driving tools normally employ fastener-feeding or fastener-advancement mechanisms which are effectively powered by means of exhaust gases which have been generated within the combustion chamber, and wherein a portion of such combustion gases have been diverted into a fastener-advancement or fastener-feeding piston-cylinder assembly. An exemplary fastener-advancement or fastener-feeding piston-cylinder assembly of the aforenoted type is disclosed and illustrated within U.S. Pat. No. 5,558,264 which issued to Weinstein on Sep. 24, 1996.

More particularly, as illustrated within FIGS. 1-3, which correspond to FIGS. 4-6 of the Weinstein patent, a fastener-advancement or fastener-feeding mechanism of the aforenoted type is seen to comprise a fastener-feeding mechanism cylinder 220 and a fastener-feeding mechanism piston 230 which is movably disposed within the fastener-feeding mechanism cylinder 220 between a retracted position as disclosed within FIG. 2 and extended positions as disclosed within FIGS. 1 and 3. The fastener-feeding mechanism cylinder 220 comprises a cylindrical wall 222, a closed end wall 224, and an annular bushing 226 fixed within the open end 228 of the cylindrical wall 222. A piston 230 is movably disposed within the cylinder 222 between a withdrawn or retracted position, as disclosed within FIG. 2, and an advanced or extended position as illustrated within FIGS. 1 and 3. The piston 230 includes a piston rod 232 which is movably guided by means of the annular bushing 226, and a coiled spring 234 is interposed between the piston 230 and the end wall 224 so as to bias the piston 230 and the piston rod 232 toward the advanced or extended position. An O-ring member 236 is seated within an annular groove 238 formed upon the piston 230 so as to provide sealing properties with respect to the cylindrical wall 222.

Still yet further, a feeding claw 240 is pivotally mounted upon the front end portion of the piston rod 232, by means of a pivot pin 242 so as to be alternatively disposed at an operative or engaged position with respect to the nails N disposed within the collated strip or array, or an inoperative or disengaged position with respect to the nails N, and a torsion spring 244 is provided so as to bias the feeding claw 240 toward its operative or engaged position. The feeding claw 240 comprises a pair of notched fingers 246 for effectively grabbing or encompassing the leading one of the nail fasteners N in order to advance or move the same forwardly under the biasing action of the spring 234, and the rear surface 248 of the rearwardly disposed finger 246 comprises a cam surface which permits the feeding claw 240 to effectively cam over the next nail fastener N to be advanced as the feeding claw 240 is pivoted to its inoperative or disengaged position, against the biasing force of the torsion spring 244, in response to the rearward movement of the piston 230 and the piston rod 232 under the influence of gas pressure admitted into the cylinder 222 by means of a conduit 274 which fluidically connects the combustion chamber of the tool to the cylinder 222. A holding claw 250, comprising at least one holding finger 260, is also pivotally mounted adjacent to the collated strip of nails N so as to be alternatively disposed at engaged and disengaged positions with respect to the next nail N disposed within the collated strip of nails N. A coil spring 254, disposed within a socket 258 of the holding claw 250, tends to bias the holding claw 250 toward its engaged position.

While the aforenoted type of fastener-advancement or fastener-feeding mechanism assuredly provides a viably operable system, this particular type of fastener-advancement or fastener-feeding mechanism is obviously only operable in connection with a combustion-powered, fastener-driving tool in view of the fact that a portion of the combustion gases must be diverted from the combustion chamber of the combustion-powered, fastener-driving tool and into the cylinder 222 in order to achieve the rearward stroke movement of the fastener-feeding piston 230, the piston rod 232, and the feeding claw 240 assembly in preparation for the feeding or advancement of a new nail fastener N toward the axial drive path along which the driver member of the combustion-powered, fastener-driving tool is movable. Accordingly, a need exists in the art for new and improved fastener-feeding or fastener-advancing systems which are adapted for use in conjunction with fastener-driving tools which are not combustion-powered and which therefore cannot utilize combustion product gases as the source of motive power for moving the feeding claw or similar mechanism in the desired direction during the operative cyclic feeding or advancing of, for example, a leading nail fastener of a collated strip of nail fasteners.

SUMMARY OF THE INVENTION

The foregoing and other objectives are achieved in accordance with the teachings and principles of the present invention through the provision of new and improved fastener-feeding or fastener-advancing systems which comprise mechanically and electro-mechanically operated systems. More particularly, in accordance with a first fastener-feeding or fastener-advancing system as constructed in accordance with the principles and teachings of the present invention, a multiple lever and linkage system, operatively connected to the fastener driver blade, causes a nail fastener feed pawl or claw to be moved to its retracted position, against the biasing force of an advancement spring and when the fastener driver blade is moved upwardly during its return stroke, so as to index over the nail fastener which is the next nail fastener to be advanced. When the operative connection defined between the driver blade and the lever and linkage system is broken, the leading nail fastener is advanced into the driver blade channel under the influence of the advancement spring such that the leading fastener is now ready to be driven and discharged from the fastener-driving tool when the driver blade is subsequently moved downwardly during the next firing cycle of the fastener-driving tool. In addition to, or in lieu of, the aforenoted mechanical lever and linkage system, various linear or rotary actuated solenoid systems are also disclosed for achieving similar leading-fastener advancement movements.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
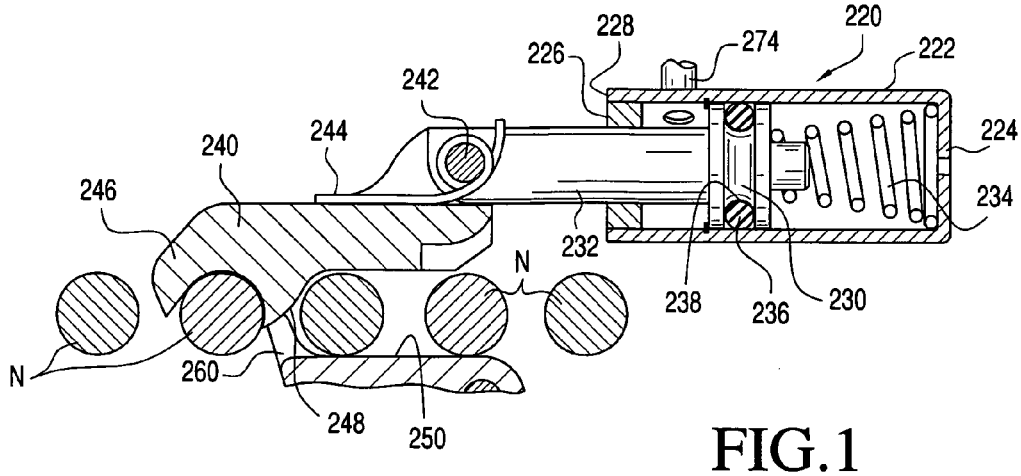
FIG.1 (PRIOR ART)
FIG. 1 is a cross-sectional view of a conventional PRIOR ART fastener advancement system wherein the fastener advancing piston assembly is disclosed at its advanced or extended position whereby the feeding claw has just indexably advanced the leading fastener of a collated strip of fasteners.
Figure 2:
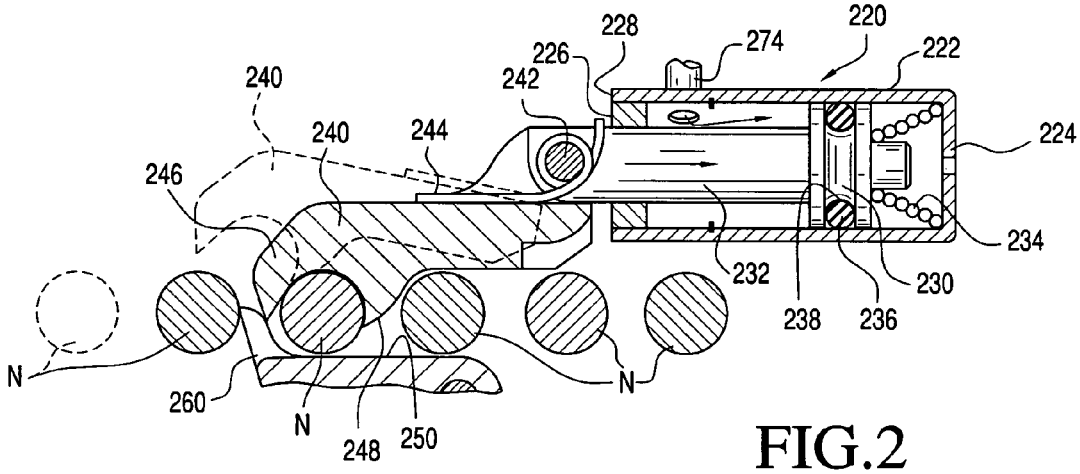
FIG.2 (PRIOR ART)
FIG. 2 is a cross-sectional view of the conventional PRIOR ART fastener advancement system as disclosed within FIG. 1 wherein, however, the fastener advancing piston assembly is disclosed as being moved or returned to its withdrawn or retracted position such that the feeding claw is ratcheted over the second fastener of the collated strip of fasteners so as to now be disposed in preparation for indexably advancing a new leading fastener of the collated strip of fasteners.
Figure 3:
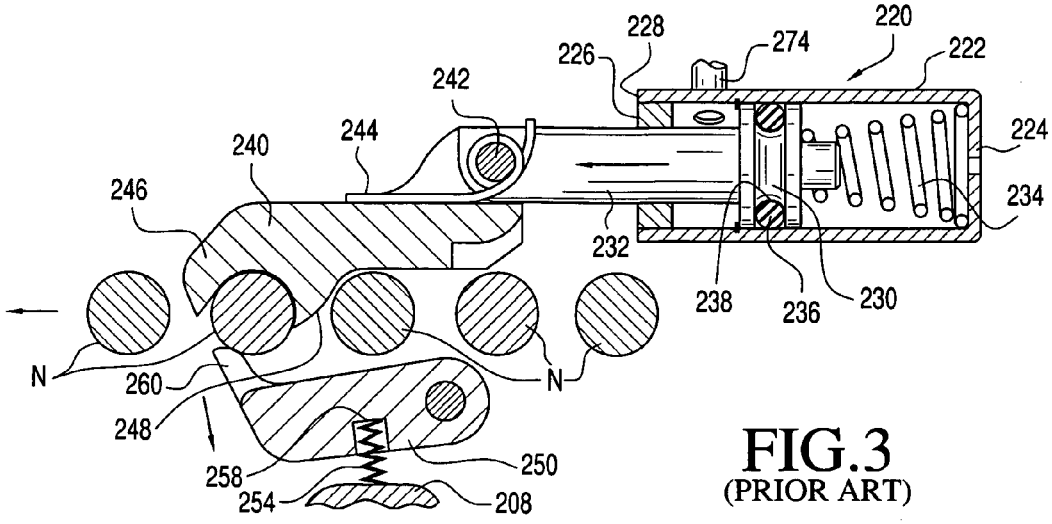
FIG.3 (PRIOR ART)
FIG. 3 is a cross-sectional view of the conventional PRIOR ART fastener advancement system, as disclosed within FIGS. 1 and 2, wherein the fastener advancing piston assembly is again disclosed at its advanced or extended position, from its withdrawn or retracted position as illustrated within FIG. 2, so as to in fact indexably advance the new leading fastener of the collated strip of fasteners.
Figure 4:
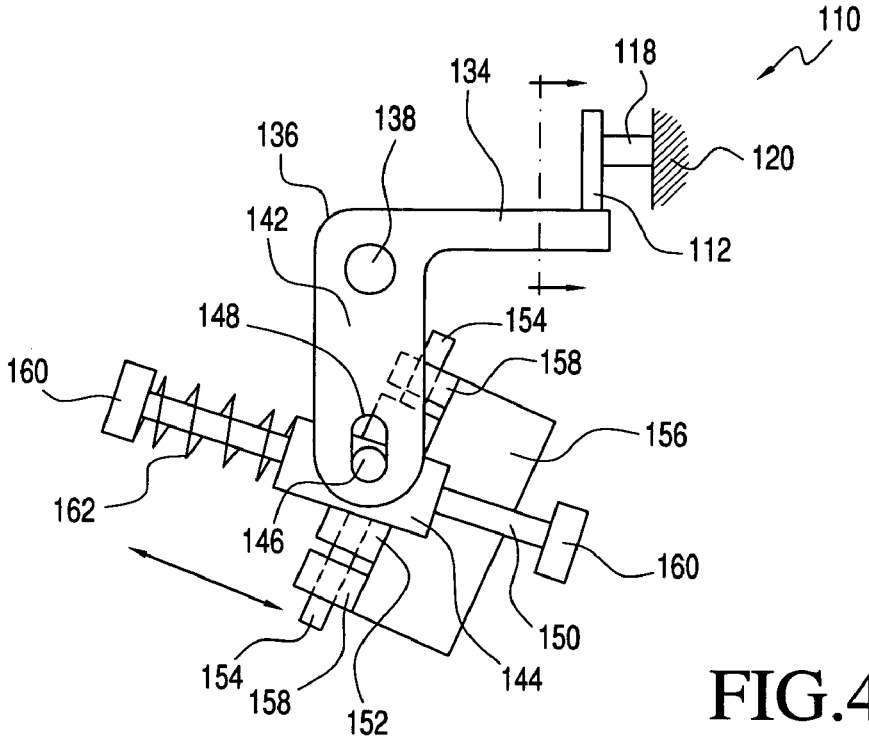
FIG. 4 is a side elevational view of a first embodiment of a new and improved mechanically actuated feed pawl fastener advancement system as constructed in accordance with the principles and teachings of the present invention and showing the operative parts thereof.
Figure 5:
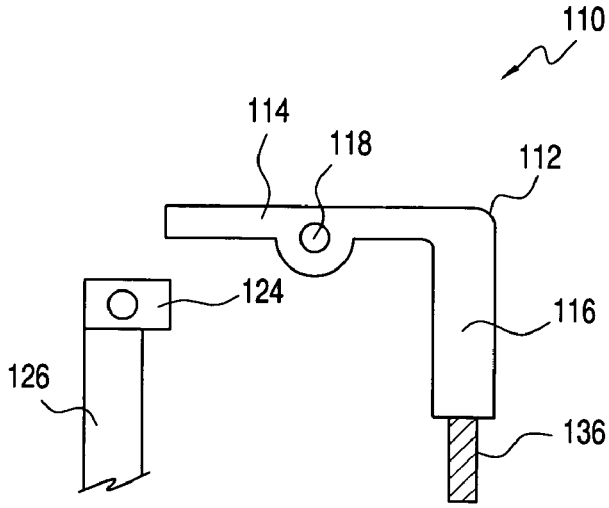
FIG. 5 is a cross-sectional view of the mechanically actuated feed pawl fastener advancement system as disclosed within FIG. 4 and as taken along the line 5-5 of FIG. 4.
Figure 6:
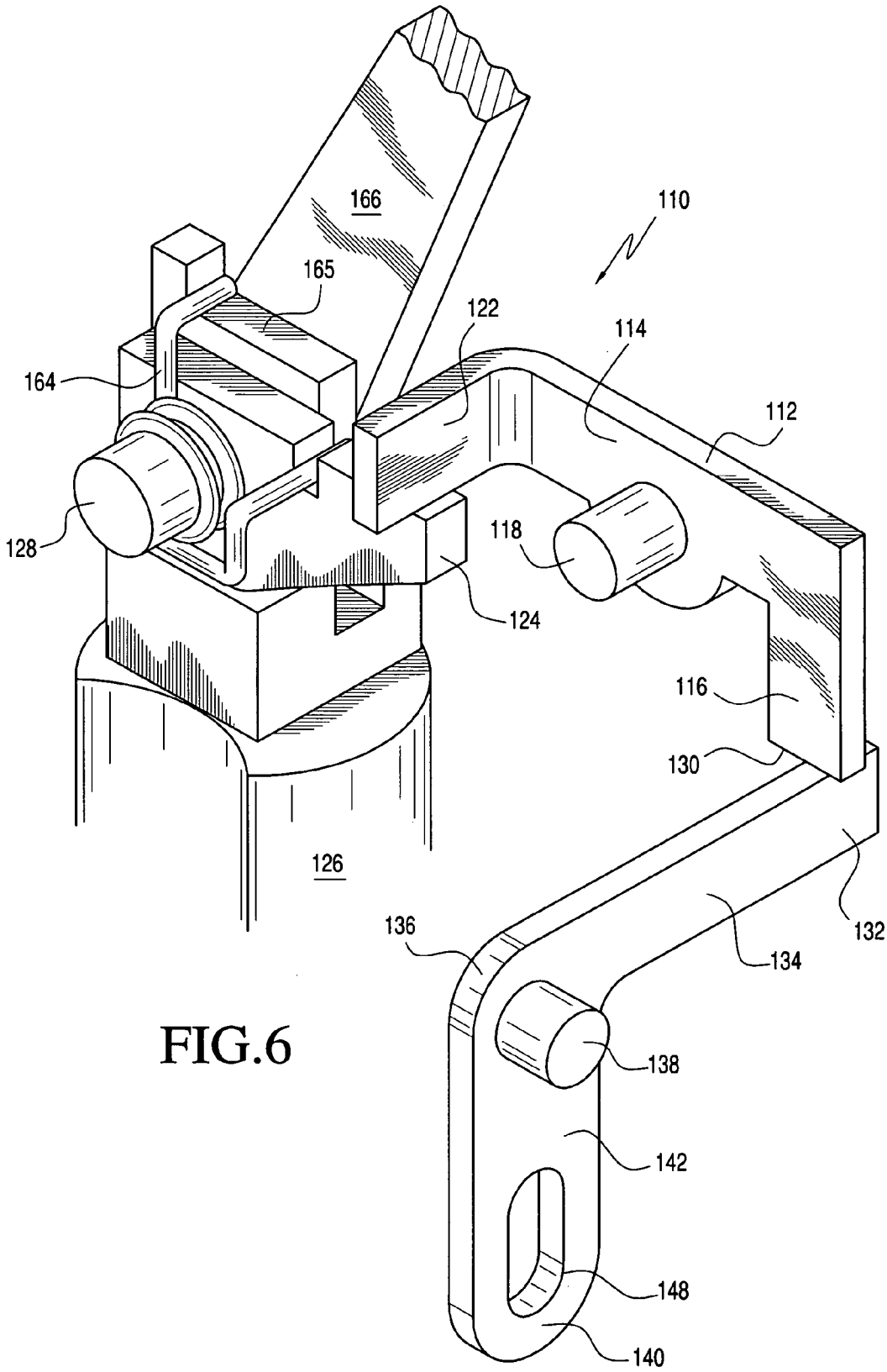
FIG. 6 is a perspective view illustrating the details comprising the interoperative connections defined between the driver blade, the trip lever, and the linkage bar components of the mechanically actuated feed pawl advancement system as disclosed within FIGS. 4 and 5.

Referring now to the drawings, and more particularly to FIGS. 4-6 thereof, a first embodiment of a new and improved fastener advancement system, constructed in accordance with the principles and teachings of the present invention, is disclosed and is generally indicated by the reference character 110. More particularly, it is seen that the fastener advancement system 110 comprises a trip lever 112 which has a substantially L-shaped cross-sectional configuration as defined by means of a relatively long, horizontally oriented leg or arm 114, and a relatively short, vertically oriented leg or arm 116. The trip lever 112 is pivotally mounted around a pivot pin 118 which passes through the relatively long, horizontally oriented leg or arm 114, and it is noted that the pivot pin 118 is fixedly mounted upon a framework portion 120 of the fastener driving tool.

The free or distal end portion 122 of the relatively long, horizontally oriented leg or arm 114 of the trip lever 112 is adapted to be disposed in operative contact with a trip pawl member 124 which is pivotally mounted upon the upper end portion of a vertically oriented driver blade 126 of the fastener driving tool by means of a link pin 128, while the free or distal end portion 130 of the relatively short, vertically oriented leg or arm 116 of the trip lever 112 is adapted to be operatively disposed in contact with the free or distal end portion 132 of a horizontally oriented leg or arm 134 of a substantially L-shaped linkage bar 136. The linkage bar 136 is pivotally mounted around a pivot pin 138, and it is further seen that the free or distal end portion 140 of the vertically oriented leg or arm 142 of the linkage bar 136 is adapted to be operatively connected to a gimbal or slide block mechanism 144 through means of a pin or post and slot assembly 146,148. It is noted that the linkage bar 136 preferably has a mechanical advantage of at least 2-3:1.

Continuing further, as can best be appreciated from FIG. 4, the gimbal or slide block mechanism 144 is slidably mounted upon a guide rail 150, and it is also seen that the gimbal or slide block mechanism 144 has a pair of transversely oriented mounting blocks 152,152 fixedly mounted thereon. The mounting blocks 152,152 have a pair of trunnions 154,154 which extend outwardly from the oppositely disposed mounting blocks 152,152, and a fastener feed pawl or claw member 156 is adapted to be pivotally mounted upon the oppositely extending trunnions 154,154 of the mounting blocks 152,152 by means of a pair of clevis-type sleeve members 158,158 such that the feed pawl or claw member 156 is capable of undergoing pivotal movement upwardly, or outwardly from the page, or downwardly or inwardly into the page. In connection with such pivotal movement of the feed pawl or claw member 156, a torsion spring, not shown but similar, for example, to the torsion spring disclosed within the PRIOR ART patent to Weinstein, is operatively associated with the feed pawl or claw member 156 so as to normally bias the feed pawl or claw member 156 downwardly or into the page. Still further, the guide rail 150 is supported at the opposite ends thereof by means of suitable support members 160,160, and a coil advancement spring 162 is disposed around the guide rail 150 so as to be interposed between the left one of the rail support members 160 and the rear end portion of the gimbal or slide block mechanism 144 so as to tend to bias the gimbal or slide block mechanism 144 in the forward direction or to the right as viewed in the drawing. Accordingly, it can be appreciated from FIGS. 4-6 that when the driver blade 126 is moved upwardly during its return stroke, the trip pawl member 124 pivotally mounted upon the upper end portion of the driver blade 126 will contact the distal or free end portion 122 of the relatively long, horizontally oriented leg or arm 114 of the trip lever 112 such that the trip lever 112 will undergo clockwise pivotal movement around the pivot pin 118 as viewed in FIGS. 5 and 6.

Continuing further, in view of the operative engagement defined between the free or distal end portion 130 of the relatively short, vertically oriented leg or arm 116 of the trip lever 112 and the free or distal end portion 132 of the horizontally oriented leg or arm 134 of the linkage bar 136, such clockwise pivotal movement of the trip lever 112 will cause the linkage bar 136 to undergo a corresponding pivotal movement in the clockwise direction around its pivot pin 138 as viewed in FIGS. 4 and 6. Therefore, still further, as a result of the pivotal movement of the linkage bar 136, and as a result of the pivotal connection defined between the free or distal end portion 140 of the vertically oriented leg or arm 142 of the linkage bar 136 and the gimbal or slide block mechanism 144 by means of the pin or post and slot assembly 146,148, the gimbal or slide block mechanism 144 will be moved toward the left, as viewed in FIG. 4, so as to undergo retractive or rearward linear movement along the guide rail 150 against the biasing force of the coil advancement spring 162. Accordingly, in view of the pivotal attachment or mounting of the fastener feed pawl or claw member 156 upon the gimbal or slide block mechanism 144, the fastener feed pawl or claw member 156 will likewise undergo rearward movement along with the gimbal or slide block mechanism 144, and at the same time, the fastener feed pawl or claw member 156 will also undergo upward, and then downward, pivotal movements around the pivotal axis defined by means of the trunnions 154,154 such that the fastener feed pawl or claw member 156 can indexably move into engagement with the next fastener disposed immediately behind the leading fastener of the collated strip of fasteners. It is to be noted at this juncture that once this series of operative steps has occurred, as the driver blade 126 continues to move upwardly, the trip pawl member 124 will effectively bypass and be disposed above the free or distal end portion 122 of the relatively long, horizontally oriented leg or arm 114 of the trip lever 112 so as to become disengaged from the free or distal end portion 122 of the relatively long, horizontally oriented leg or arm 114 of the trip lever 112. Accordingly, the entire linkage and lever system, comprising the trip lever 112, the linkage bar 136, the gimbal or slide block mechanism 144, and the fastener feed pawl or claw member 156, will be returned to their previous positions under the influence of the biasing force of the coil advancement spring 162. Most importantly, the gimbal or slide block mechanism 144, and the fastener feed pawl or claw member 156, will effectively be advanced in the forward direction so as to in fact advance the leading fastener into the drive channel, not shown, within which the driver blade 126 is reciprocally disposed so as to be predisposed in position for impact by the driver blade 126 when a new fastener driving and discharge cycle is to be performed.

More particularly, in connection with such fastener driving and discharge operation, it is recalled that as the driver blade 126 completes its upward or return movement, the trip pawl member 124 will effectively be disposed above the free or distal end portion 122 of the relatively long, horizontally oriented leg or arm 114 of the trip lever 112. It is further seen that the trip pawl member 124, which is pivotally mounted around the link pin 128, is biased into its position, as illustrated within FIG. 6, by means of a torsion return spring 164 as a result of one end of the torsion return spring 164 being fixedly mounted upon an upstanding extension 165 of the driver blade 126, while the other end of the torsion return spring 164 is operatively engaged with the trip pawl member 124, and that the driver blade 126 is also operatively connected to a drive link 166 of a tool power mechanism, not shown, by means of link pin 128. It is therefore to be appreciated that when the fastener tool is fired so as to drive and discharge the leading fastener out from the fastener-driving tool, the driver blade 126 will be moved downwardly, as viewed in FIG. 6, whereby, as a result of the contact between the trip pawl member 124 and the free or distal end portion 122 of the relatively long, horizontally oriented leg or arm 114 of the trip lever 112, the trip pawl member 124 will pivot in the counterclockwise direction around the link pin 128, as viewed in FIG. 6, so as to in fact permit the driver blade 126 to move downwardly in an unimpeded manner and thereby drive the leading fastener through the drive channel and outwardly from the fastener-driving tool.

Figure 7:
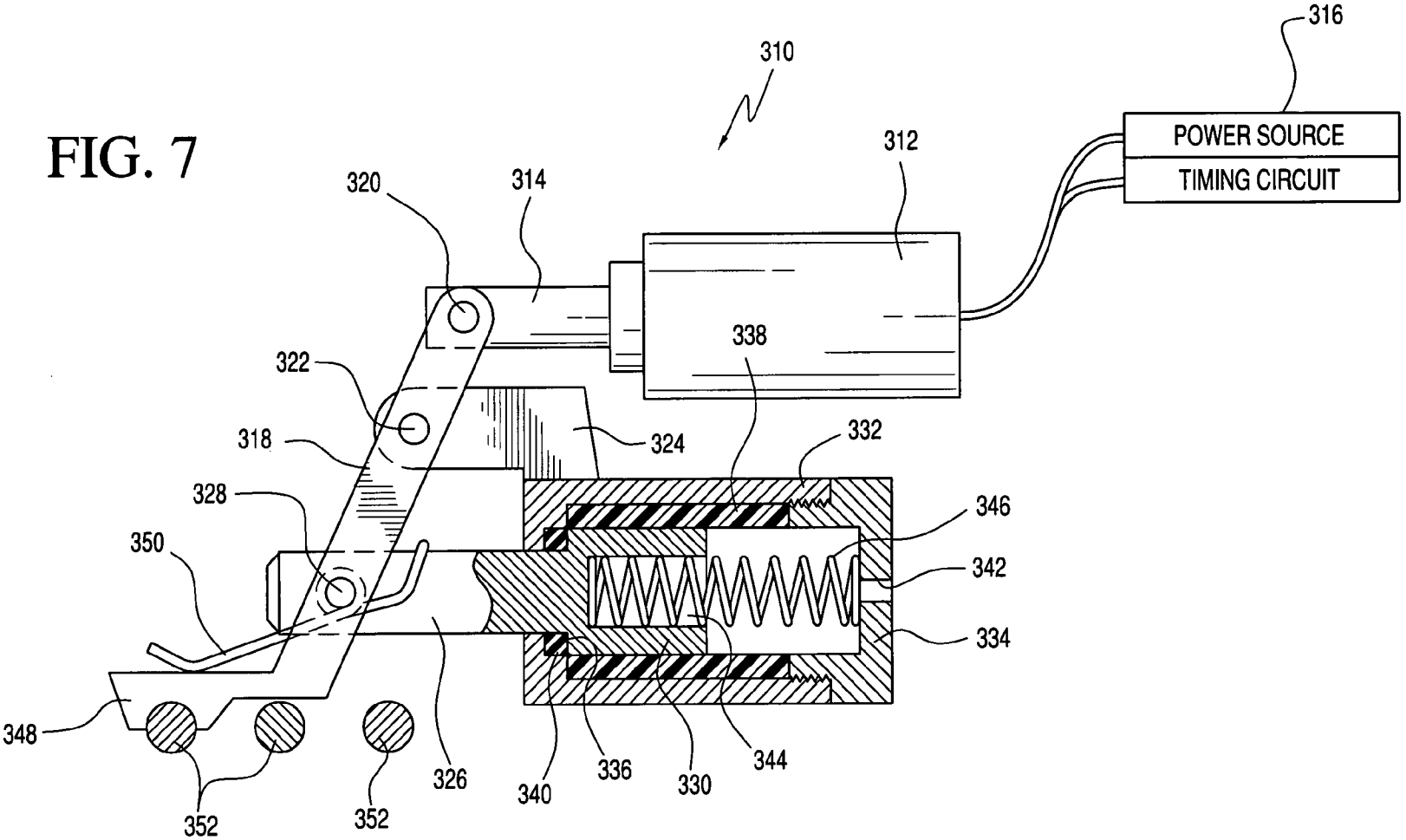
FIG. 7 is a top plan view, partly in cross-section, of a second embodiment of a new and improved electro-mechanically actuated feed pawl fastener advancement system, comprising the use of a push-type solenoid actuator, as constructed in accordance with the principles and teachings of the present invention and showing the operative parts thereof.

With reference now being made to FIG. 7, in lieu of utilizing a mechanically-actuated fastener advancement system, such as that as has been disclosed within FIGS. 4-6, for indexably advancing leading fasteners of a collated strip of fasteners, an electro-mechanically-actuated fastener advancement system can likewise be employed. Accordingly, a second embodiment of a new and improved fastener advancement system, comprising, for example, a push-type solenoid-actuated mechanism, is disclosed and is generally indicated by the reference character 310. More particularly, the electro-mechanically-actuated fastener advancement system 310 is seen to comprise a push-type solenoid component 312 which comprises a linearly movable, reciprocating actuation rod or plunger 314. The solenoid mechanism 312 is electrically connected to a power source and timing circuit 316, and the free or distal end portion of the solenoid actuation rod or plunger 314 is connected to one end of a yoke member 318 by means of a first pivot pin 320. The yoke member 318 is pivotally movable, at an intermediate section thereof, around a second pivot pin 322 which is fixedly mounted upon a bracket member 324 which is integral attached to the tool nosepiece structure, while a second opposite end of the yoke member 318 is pivotally connected to a linearly movable control rod 326 by means of a third pivot pin 328. It is noted that the spacing or effective distance defined between the first and second pivot pins 320,322, as compared to the spacing or effective distance defined between the second and third pivot pins 322,328 is such that when the yoke member 318 undergoes, for example, counterclockwise pivotal movement under the influence of the solenoid component 312, a mechanical advantage of at least 2:1 or 3:1 is effectively created.

The control rod 326 is integrally connected to a tubular body portion or piston member 330 which is adapted to be movable in a reciprocal manner within a cylindrical housing 332 which also comprises a part of the tool nosepiece structure, and it is seen that the cylindrical housing 332 is provided with an end cap 334 so as to effectively close the rear end of the housing 332. The tubular body portion or piston member 330 has a diametrical extent which is larger than the diametrical extent of the control rod 326 such that the integral structure comprising the control rod 326 and the tubular body portion or piston member 330 has a stepped configuration, and in this manner, an annular shoulder portion 336 is effectively defined at the interface defined between the control rod 326 and the tubular body portion 330. An annular bearing member 338 is fixedly disposed within cylindrical housing 332 so as to facilitate the smooth reciprocal movement of the tubular body portion or piston member 330 therealong and interiorly within the cylindrical housing 332, and an annular seal member 340 is disposed at the forward end of the cylindrical housing 332 so as to effectively provide a sealed environment around the control rod 326 as the same undergoes its linear reciprocal movements relative to the cylindrical housing 332. The seal member 340 also effectively serves as a stop member against which the annular shoulder portion 336 of the tubular body portion or piston member 330 will abut so as to effectively limit the forward stroke of the control rod 326, and it is also seen that the end cap 334 is provided with a vent hole 342 so as to permit the air, present within the cylindrical housing 332, to be exhausted when the tubular body portion or piston member 330 is moved rearwardly within the cylindrical housing 332.

It is further seen that the tubular body portion or piston member 330 is provided with a rearwardly open blind bore 344, and accordingly, one end of a coil return spring 346 is adapted to be seated within the blind bore 344 while the opposite end of the coil return spring 346 is seated upon the interior wall surface of the end cap 334. In this manner, as can be readily appreciated, when the solenoid component is activated so as to extend or project the actuation rod or plunger 314 outwardly therefrom whereby the yoke member 318 will be pivotally moved in the counterclockwise direction so as to linearly move the control rod 326 in the rearward direction against the biasing force of the coil return spring 346, that is, toward the right as viewed in FIG. 7, so as to compress the coil return spring 346. Conversely, when the solenoid component 312 is deactivated, the coil return spring 346 will cause the control rod 326 to be linearly moved in the forward direction, that is, toward the left as viewed in FIG. 7. It is further seen that a fastener feed pawl or claw 348 is also pivotally mounted upon the control rod 326 by means of the third pivot pin 328, and a torsion spring 350 is mounted upon the control rod 326 in such a manner that one end of the torsion spring 350 is engaged with the control rod 326, the coiled body of the torsion spring 350 is disposed around the third pivot pin 28, and a second opposite end of the torsion spring 350 is operatively engaged with the fastener feed pawl or claw 348 so as to bias the same toward the collated strip of nail fasteners 352.

The operation of the new and improved electro-mechanically-actuated fastener advancement system 310, constructed in accordance with the principles and teachings of the present invention is submitted to be readily appreciated, however, a brief summary of an operational cycle will now be briefly described. After the fastener-driving tool has been fired so as to drive and discharge the leading one of the fasteners from the collated strip of fasteners 352, and the driver blade is returned to its elevated position, the timing circuit 316 is initiated by means, for example, of a suitable signal indicating the return of the driver blade to its retracted pre-firing position, whereby the solenoid component 312 is enabled or activated so as to extend or project the actuation rod or plunger 314. Extension of the actuation rod or plunger 314 causes the yoke member 318 to be pivoted in the counterclockwise direction whereby the control rod 326 will be moved toward the right as viewed in FIG. 7 against the biasing force of the coil return spring 346. Movement of the control rod 326 toward the right causes the fastener feed pawl or claw 348 to likewise be moved toward the right whereby the fastener feed pawl or claw 348 is able to pivotally move upwardly, against the biasing force of the torsion spring 350, to pass over the first or new leading fastener 352 as illustrated within FIG. 7, and to then pivot downwardly under the influence of the biasing force of the torsion spring 350 so as to become engaged with the second fastener 352 as illustrated within FIG. 7. Subsequently, the timing circuit 316 times out, the solenoid component 312 is deactivated, and the coil return spring 346 is able to linearly push the control rod 326 toward the left as viewed in FIG. 7 so as to now effectively advance the first or new leading fastener 352 into the driver blade channel in preparation for a new firing sequence by means of the fastener-driving tool.

Figure 8:
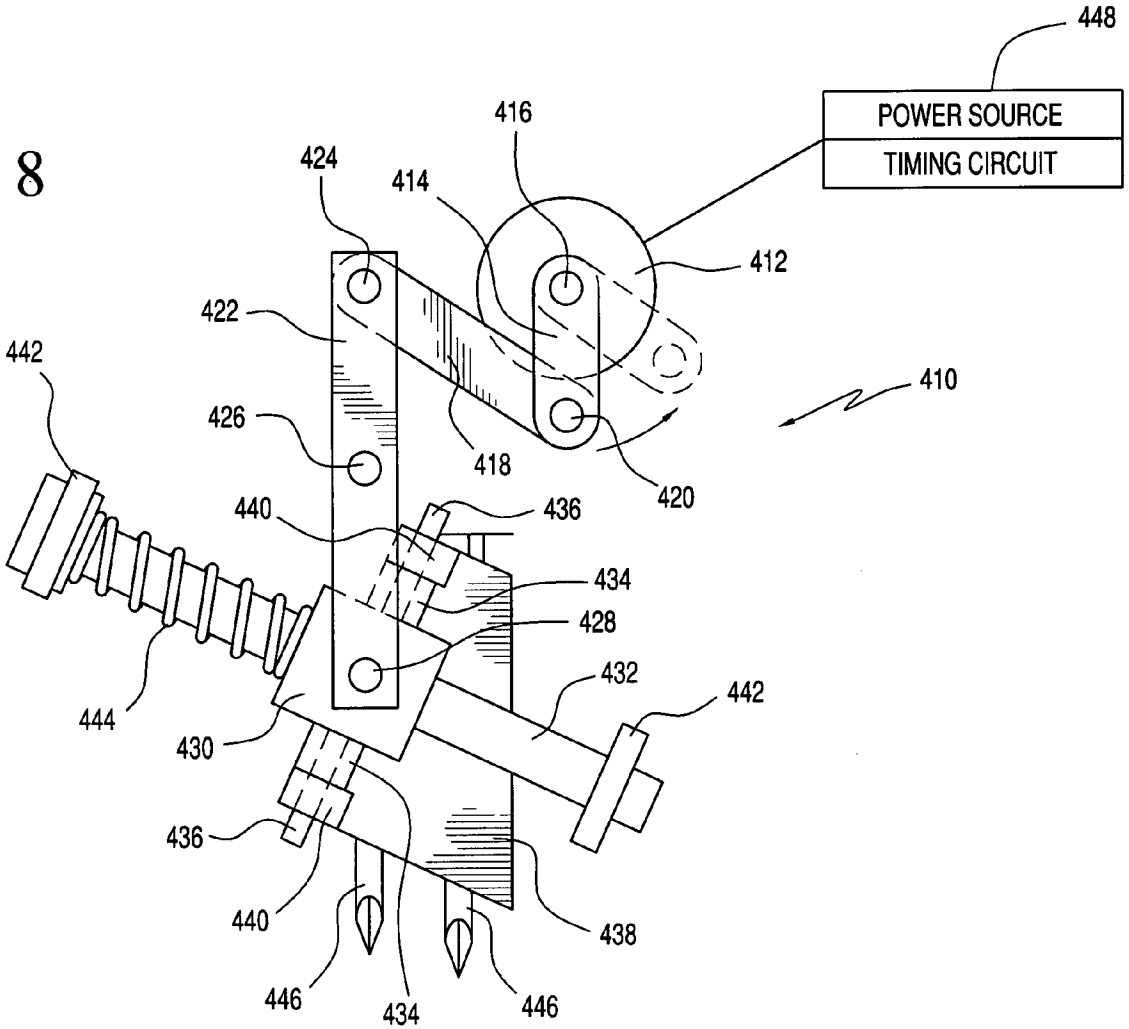
FIG. 8 is a side elevational view of a third embodiment of a new and improved electro-mechanically actuated feed pawl fastener advancement system, comprising the use of a rotary-type solenoid actuator, as constructed in accordance with the principles and teachings of the present invention and showing the operative parts thereof.

With reference now being made to FIG. 8, a third embodiment of a new and improved fastener advancement system, and comprising, for example, a second type of electro-mechanically-actuated fastener advancement system which is somewhat similar to the first type of electro-mechanically-actuated fastener advancement system as illustrated within FIG. 7, and also having some operative components corresponding to those characteristic of the first embodiment fastener advancement system as illustrated within FIG. 4, is disclosed and is generally indicated by the reference character 410. More particularly, it is initially noted that one of the primary differences between the fastener advancement system 410 as disclosed within FIG. 8, and the fastener advancement system 310 as disclosed within FIG. 7, resides in the fact that within the fastener advancement system as illustrated within FIG. 8, the solenoid component 412 comprises a rotary solenoid as opposed to a linear solenoid as is characteristic of the solenoid component 312. Accordingly, it is seen that the solenoid component 412 has a crank member 414 fixedly mounted at one end thereof upon the rotary output shaft 416 of the solenoid component 412 such that when the solenoid component 412 is activated, the crank member 414 will be rotated or pivoted in the counterclockwise direction through means of a predetermined angular extent, such as, for example, 67.5°, from the illustrated solid line position to the illustrated dotted line position.

It is further seen that the opposite end of the crank member 414 is pivotally connected to a first end of a linkage arm 418 by means of a first pivot pin 420, and a second opposite end of the linkage arm 418 is pivotally connected to a first end of a yoke or indexing arm 422 by means of a second pivot pin 424. The yoke or indexing arm 422 is pivotally mounted at an intermediate region thereof by means of a third pivot pin 426, and the opposite end of the yoke or indexing arm 422 is pivotally connected to a fourth pivot pin or post 428 of a gimbal or slide block 430. As was the case with the yoke member 318, and its operative connection to the actuation rod or plunger 314 of the solenoid component 312, as well as its operative connection to the control rod 326, it is noted that the spacing or effective distance defined between the second and third pivot pins 424,426, as compared to the spacing or effective distance defined between the third and fourth pivot pins 426,428 is such that when the yoke or indexing arm 422 undergoes, for example, counter-clockwise pivotal movement under the influence of the solenoid component 412, a mechanical advantage of at least 2:1 or 3:1 is effectively created. Still further, as was also the case with the gimbal or slide block mechanism 144 of the fastener advancement system 110 as illustrated within FIG. 4, the gimbal or slide block mechanism 430 is slidably mounted upon a guide rail 432.

It is also seen that the gimbal or slide block mechanism 430 has a pair of transversely oriented mounting blocks 434,434 fixedly mounted thereon, and the mounting blocks 434,434 have a pair of trunnions 436,436 which extend outwardly from the oppositely disposed mounting blocks 434, 434. A fastener feed pawl or claw member 438 is adapted to be pivotally mounted upon the oppositely extending trunnions 436,436 of the mounting blocks 434,434 by means of a pair of clevis-type sleeve members 440,440, and in this manner, the feed pawl or claw member 438 is capable of undergoing pivotal movement upwardly, or outwardly from the page, or downwardly or inwardly into the page. In connection with such pivotal movement of the feed pawl or claw member 438, a torsion spring, not shown but similar, again, for example, to the torsion spring disclosed within the PRIOR ART patent to Weinstein, is operatively associated with the feed pawl or claw member 438 so as to bias the feed pawl or claw member 438 downwardly or into the page. Still further, the guide rail 432 is supported at the opposite ends thereof by means of suitable support members 442,442, and a coil advancement spring 444 is disposed around the guide rail 432 so as to be interposed between one of the rail support members 442 and the rear end portion of the gimbal or slide block mechanism 430 so as to tend to bias the gimbal or slide block mechanism 430 in the forward or fastener advancement direction.

In operation, after the fastener-driving tool has been fired so as to drive and discharge the leading one of the fasteners from the collated strip of fasteners 446, and the driver blade is returned to its elevated position, the timing circuit 448 is initiated whereby the solenoid component 412 is enabled or activated so as to angularly rotate the crank arm 414 in the counterclockwise direction. The angular rotation of the crank arm 414 in the counterclockwise direction causes the linkage arm 418 to be moved therewith so as to, in turn, cause the yoke member or indexing arm 422 to be pivoted in the clockwise direction whereby the gimbal or slide block 430 will be moved toward the left as viewed in FIG. 8 against the biasing force of the coil return or advancement spring 444. Movement of the gimbal or slide block 430 toward the left causes the fastener feed pawl or claw 438 to likewise be moved toward the left whereby the fastener feed pawl or claw 438 is able to pivotally move upwardly or out of the page, against the biasing force of the torsion spring, not shown, to pass over the first or new leading fastener 446 as illustrated within FIG. 8, and to then pivot downwardly or into the page under the influence of the biasing force of the torsion spring, not shown, so as to become engaged with the second fastener 446 as illustrated in FIG. 8. Subsequently, the timing circuit 448 times out, the solenoid component 412 is deactivated, and the coil return or advancement spring 444 is able to linearly push the gimbal or slide block 430 toward the right as viewed in FIG. 8 so as to accordingly cause the fastener feed pawl or claw 438 to advance the first or new leading fastener 446 into the driver blade channel in preparation for a new firing sequence by means of the fastener-driving tool.

Figure 9:
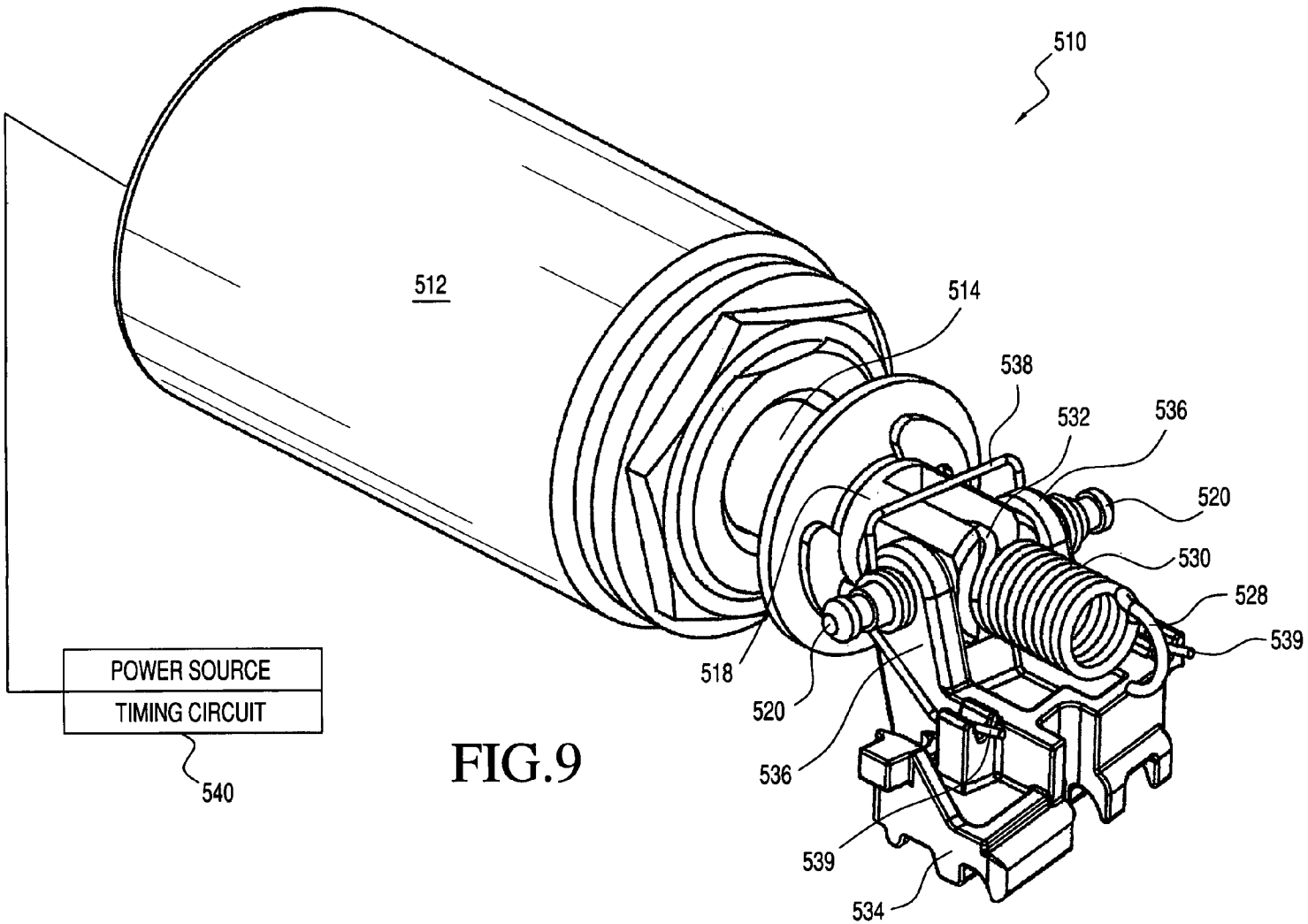
FIG. 9 is a side perspective view of a fourth embodiment of a new and improved electro-mechanically actuated feed pawl fastener advancement system, comprising the use of a pull-type solenoid actuator, as constructed in accordance with the principles and teachings of the present invention and showing the operative parts thereof.

With reference now being made to FIG. 9, a fourth embodiment of a new and improved fastener advancement system, and comprising, for example, a third type of electro-mechanically-actuated fastener advancement system which is somewhat similar to the first type of electro-mechanically-actuated fastener advancement system as illustrated within FIG. 7, is disclosed and is generally indicated by the reference character 510. It is initially noted that in lieu of the solenoid component being a linearly movable, push or extension-type solenoid, as characterized by means of the solenoid component 312 illustrated within FIG. 7, the solenoid component 512 is a linearly movable, pull or retraction type solenoid wherein the solenoid component 512 comprises a retraction rod or plunger 514. The forward, distal, or free end portion of the solenoid retraction rod or plunger 514 comprises a clevis portion 518, and a rod extends transversely through the transversely spaced wall members of the clevis portion 518 so as to effectively form or define a pair of transversely spaced pivot pins 520,520. A first end portion 528 of a return or advancement coil spring 530 is adapted to be connected to a fixed portion of the tool nosepiece, not shown, while a second opposite end 532 of the return or advancement coil spring 530 is mounted around the rod transversely mounted within the clevis 518 so as to bias the solenoid retraction rod or plunger 514 in the forward or fastener advancement direction. A fastener feed pawl or claw 534 has a pair of transversely spaced, upstanding ears or lugs 536,536 respectively pivotally mounted upon the pair of pivot pins 520,520, and a torsion spring member 538 is mounted upon the clevis end portion 518 of the solenoid component 512 such that opposite end portions 539,539 thereof are operatively engaged with the opposite sides of the fastener feed pawl or claw 534 so as to effectively bias the same downwardly or into the page as viewed in FIG. 9.

Accordingly, in operation, after the fastener-driving tool has been fired so as to drive and discharge the leading one of the fasteners from the collated strip of fasteners, and the driver blade has been returned to its elevated position, the timing circuit 540 is initiated whereby the solenoid component 512 is enabled or activated so as to effectively retract the solenoid rod or plunger 514 toward the left as viewed in FIG. 9. This retraction of the solenoid rod or plunger 514 causes the clevis end portion 518 thereof, the transversely oriented shaft upon which the pivot pins 520,520 are defined, and the fastener feed pawl or claw 534, mounted upon the pivot pins 520,520 by means of the upstanding ears or lugs 536,536, to likewise be moved toward the left as viewed in FIG. 9 against the biasing force of the coil return or advancement coil spring 530. Accordingly, the fastener feed pawl or claw 534 is able to pivotally move upwardly or out of the page, against the biasing force of the torsion spring 538, so as to pass over the first or new leading fastener of the collated strip of fasteners, and to then pivot downwardly or into the page under the influence of the biasing force of the torsion spring 538 so as to become engaged with the second fastener of the collated strip of fasteners. Subsequently, the timing circuit 540 times out, the solenoid component 512 is deactivated, and the coil return or advancement spring 530 is able to linearly pull the fastener feed pawl or claw 534 toward the right as viewed in FIG. 9 so as to accordingly advance the first or new leading fastener into the driver blade channel in preparation for a new firing sequence by means of the fastener-driving tool.

Figure 10:
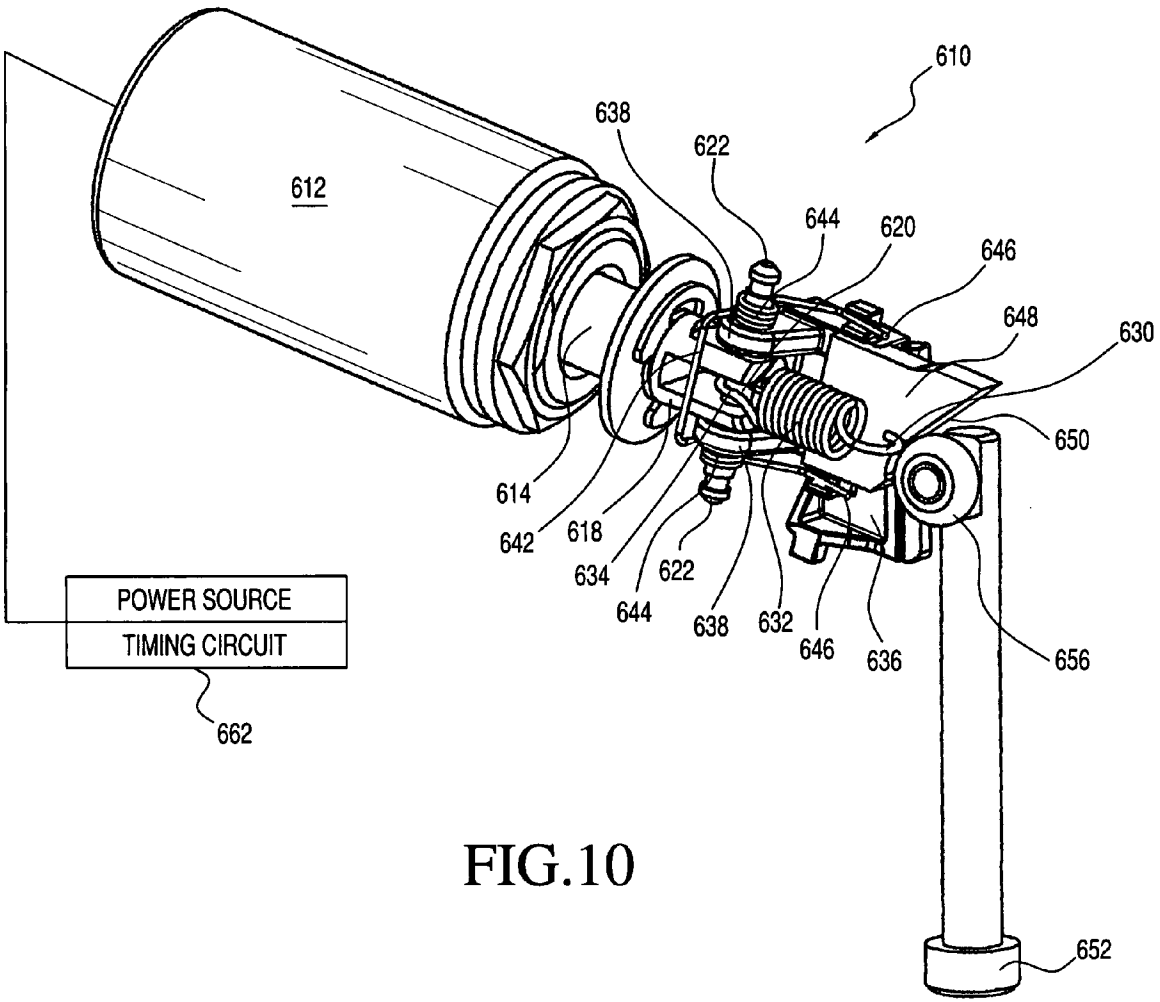
FIG. 10 is a side perspective view of a fifth embodiment of a new and improved electro-mechanically actuated feed pawl fastener advancement system similar to the fourth embodiment feed pawl fastener advancement system as disclosed within FIG. 9 but comprising the use of a mechanically-assisted pull-type solenoid actuator, as constructed in accordance with the principles and teachings of the present invention and showing the operative parts thereof.

With reference lastly being made to FIG. 10, a fifth embodiment of a new and improved fastener advancement system, and comprising, for example, a fourth type of electro-mechanically-actuated fastener advancement system which is somewhat similar to the third type of electro-mechanically-actuated fastener advancement system as illustrated within FIG. 9, is disclosed and is generally indicated by the reference character 610. It is initially noted that, in connection with solenoid-actuated mechanisms, a solenoid coil is most effective when the rod or plunger is disposed fully within the electromagnetic field generated by means of the solenoid coil. Accordingly, the power requirements needed to actuate or move the solenoid actuation rod or plunger a predetermined distance will vary with, or are a function of, the distance that the solenoid rod or plunger is located from the solenoid coil. Therefore, it has been determined that if the solenoid rod or plunger can initially be moved toward its retracted direction so as to effectively be disposed closer to the solenoid coil prior to the actual activation or energization of the solenoid coil, the solenoid coil would not have to generate as much power as it would otherwise normally be required to do in order to move the solenoid rod or plunger a predetermined distance or to its fully retracted position, and therefore, the size and weight of the solenoid mechanism can effectively be reduced which is highly desirable within a portable tool.

Continuing further, then, it is seen that, as was the case with the electro-mechanically-actuated fastener advancement system 510, comprising a linearly movable, pull or retraction type solenoid component 512 as illustrated within FIG. 9, the electro-mechanically-actuated fastener advancement system 610 comprises a solenoid component 612 having a retraction rod or plunger 614 operatively associated therewith, and it is to be appreciated that the solenoid component 612 may be mounted upon the tool nosepiece, not shown. The forward, distal, or free end portion of the solenoid retraction rod or plunger 614 comprises a clevis portion 618, and a rod 620 extends transversely through the transversely spaced wall members of the clevis portion 618 so as to effectively form or define a pair of transversely spaced pivot pins 622,622. A first end portion 630 of a return or advancement coil spring 632 is adapted to be connected to a fixed portion of the tool nosepiece, not shown, while a second opposite end portion 634 of the return or advancement coil spring 632 is mounted around the transversely oriented rod 620 mounted within the transversely spaced wall members of the clevis portion 618 so as to bias the solenoid retraction rod or plunger 614 in the forward or fastener advancement direction.

A fastener feed pawl or claw 636 is disposed beneath the tool nosepiece structure, not shown, and has a pair of transversely spaced ears or lugs 638,638 which project upwardly through an opening defined within the tool nosepiece structure, not shown, so as to be respectively pivotally mounted upon the pair of pivot pins 622,622. Still further, a torsion spring member 642 is mounted upon the clevis end portion 618 of the solenoid component 612 in such a manner that the torsion spring member 642 has coiled portions 644,644 respectively disposed around the pivot pins 622,622 while opposite end portions 646,646 thereof are operatively engaged with the opposite sides of the fastener feed pawl or claw 636 so as to effectively bias the same downwardly or into the page as viewed in FIG. 10. Still yet further, it is to be appreciated that this fifth embodiment electro-mechanically-actuated fastener advancement system 610 comprises a mechanically assisted electro-mechanically-actuated fastener advancement system such that, as has been noted hereinbefore, the power requirements of the solenoid component 612 can effectively be reduced. Accordingly, it is seen that, in addition to the aforenoted structure, which substantially corresponds to the structure comprising the electro-mechanically-actuated fastener advancement system 510 as illustrated within FIG. 9, the fastener feed pawl or claw 636 further comprises a cam follower 648 which is integrally connected thereto and which has a first angled cam follower surface portion 650 which is always adapted to be disposed over and seated upon the nosepiece structure, not shown, when the fastener feed pawl or claw 636, and the integrally connected cam follower 648, are disposed in their relatively downward positions. A work contact element 652 is movably mounted within the nosepiece structure, not shown, and the distal end of the work contact element 652 has a cam roller 656 which is rotatably mounted thereon for engagement with the cam follower surface portion 650 of the cam follower 648.

Accordingly, in operation, when the fastener-driving tool is to be fired, the work contact element 652 is initially disposed in contact with the workpiece into which a fastener is to be driven so as to in fact permit the fastener-driving tool to be fired in a safe manner, and accordingly, as a result of the upward movement of the work contact element 652, as viewed in FIG. 10, the cam roller 656 will interact with the cam follower surface portion 650 of the cam follower 648 so as to move the cam follower 648, and the fastener feed pawl or claw 636 integrally attached thereto, a predetermined distance in the leftward direction, as viewed in FIG. 10, against the biasing force of the coil return spring 632. As was the case, for example, with the previous embodiments as noted in connection with FIGS. 7-9, after the fastener-driving tool has in fact been fired so as to drive and discharge the leading one of the fasteners from the collated strip of fasteners, and after the driver blade has been returned to its elevated pre-firing position, a signal to this effect is transmitted to the timing circuit 662 so as to initiate the timing circuit 662 whereby the timing circuit 662, in turn, enables or activates the solenoid 612 so as to effectively retract the solenoid rod or plunger 614 the remaining predetermined distance in the leftward direction, as viewed in FIG. 10, so as to completely retract the solenoid rod or plunger 614.

This complete retraction of the solenoid rod or plunger 614 causes the clevis end portion 618 thereof, the transversely oriented shaft 620 upon which the pivot pins 622, 622 are defined, and the fastener feed pawl or claw 636, mounted upon the pivot pins 622,622 by means of the upstanding ears or lugs 638,638, to likewise be moved toward the left as viewed in FIG. 10 against the biasing force of the coil return or advancement coil spring 632. Accordingly, the fastener feed pawl or claw 636 is able to pivotally move upwardly or out of the page, against the biasing force of the torsion spring 642, so as to pass over the first or new leading fastener of the collated strip of fasteners, and to then pivot downwardly or into the page under the influence of the biasing force of the torsion spring 642 so as to become engaged with the second fastener of the collated strip of fasteners. Subsequently, the timing circuit 662 times out, the solenoid component 612 is deactivated, and the coil return or advancement spring 632 is able to linearly pull the fastener feed pawl or claw 636 toward the right as viewed in FIG. 10 so as to accordingly advance the first or new leading fastener into the driver blade channel in preparation for a new firing sequence by means of the fastener-driving tool.

Thus, it may be seen that in accordance with the principles and teachings of the present invention there has been described several embodiments of new and improved fastener-feeding or fastener-advancing systems which comprise mechanically and electro-mechanically operated systems. More particularly, a first fastener-feeding or fastener-advancing system comprises a multiple lever and linkage system which is operatively connected to the fastener driver blade and which causes a nail fastener feed pawl or claw to be moved to its retracted position against the biasing force of an advancement spring when the fastener driver blade is moved upwardly during its return stroke. The fastener feed pawl or claw therefore indexes over the nail fastener which is the next nail fastener to be advanced, and when the operative connection defined between the fastener driving blade and the lever and linkage system is effectively broken, the fastener feed pawl or claw advances the leading nail fastener into the driver blade channel under the influence of the advancement spring such that the leading fastener is now ready to be driven and discharged from the fastener-driving tool when the driver blade is subsequently moved downwardly during the next firing cycle of the fastener-driving tool. In addition to, or in lieu of, the aforenoted mechanical lever and linkage system, various linear push or pull-type, or rotary actuated, solenoid systems are also disclosed for retracting and advancing fastener feed pawls or claws so as to achieve similar leading-fastener indexable advancement movements for moving the leading fasteners into the driver blade channel.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A fastener advancement system for use within a fastener-driving tool, comprising:

driving means, reciprocally mounted within a driving channel of a fastener-driving tool for movement between a rearward retracted position and a forward extended position, for driving a leading fastener, of a collated strip of fasteners, through the driving channel, and for discharging the leading fastener of the collated strip of fasteners out from the fastener-driving tool; and means, operatively connected to said driving means and movable in response to rearward movement of said driving means, for separating the leading fastener of the collated strip of fasteners from the remaining fasteners of the collated strip of fasteners, and for advancing the leading fastener of the collated strip of fasteners into the driving channel of the fastener-driving tool, when said driving means is substantially disposed at said rearward retracted position so as to predispose the leading fastener of the collated strip of fasteners within the driving channel of the fastener-driving tool in preparation for the driving and discharging of the leading fastener of the collated strip of fasteners through the driving channel of the fastener-driving tool and out from the fastener-driving tool by said driving means when said driving means is moved from said rearward retracted position toward said forward extended position.

2. The fastener-advancement system as set forth in claim 1, wherein:

said driving means comprises a driver blade.

3. The fastener-advancement system as set forth in claim 2, wherein:

said means, operatively connected to said driver blade, for separating the leading fastener of the collated strip of fasteners from the remaining fasteners of the collated strip of fasteners, and for advancing the leading fastener of the collated strip of fasteners into the driving channel of the fastener-driving tool, comprises a mechanical system operatively engageable with said driver blade.

4. The fastener-advancement system as set forth in claim 3, wherein said mechanical system comprises:

a fastener-advancement feed pawl;

spring means operatively engaged with said fastener-advancement feed pawl for biasing said fastener-advancement feed pawl in a forward, fastener-advancement direction;

a linkage bar operatively connected at a first end portion thereof to said fastener-advancement feed pawl; and a trip lever operatively connected at a first end portion thereof to a second end portion of said linkage bar, and operatively connected at a second end portion thereof to said driver blade such that when said driver blade moves from said forward extended position toward said rearward retracted position, a portion of said driver blade will engage said trip lever so as to cause said trip lever to move said linkage bar so as to, in turn, cause said linkage bar to move said fastener-advancement feed pawl in a rearward retracted direction, against the biasing force of said spring means, so as to engage the fastener disposed behind the leading fastener within the collated strip of fasteners, and when said portion of said driver blade bypasses said trip lever, said biasing force of said spring means will cause said fastener-advancement feed pawl to move in a forward extended direction so as to advance the leading fastener of the collated strip of fasteners into the driving channel of the fastener-driving tool.

5. The fastener-advancement system as set forth in claim 4, wherein:

said trip lever and said linkage bar are pivotally mounted; and said portion of said driver blade for engaging said trip lever comprises a trip pawl member pivotally mounted up-on said driver blade.

6. The fastener-advancement system as set forth in claim 2, wherein:

said means, operatively connected to said driver blade, for separating the leading fastener of the collated strip of fasteners from the remaining fasteners of the collated strip of fasteners, and for advancing the leading fastener of the collated strip of fasteners into the driving channel of the fastener-driving tool, comprises an electro-mechanical system operatively engageable with said driver blade.

7. The fastener-advancement system as set forth in claim 6, wherein said electro-mechanical system comprises:

a fastener-advancement feed pawl;

spring-biased means operatively engaged with said fastener-advancement feed pawl for biasing said fastener-advancement feed pawl in a forward, fastener-advancement direction;

a linearly movable push-type solenoid means operatively connected to said spring-biased means; and timing circuit means operatively connected to said linearly movable push-type solenoid means for energizing said linearly movable push-type solenoid means so as to cause said spring-biased means to move said fastener-advancement feed pawl in a rearward retracted direction, against the biasing force of said spring-biased means, when said driver blade moves from said forward extended position toward said rearward retracted position, so as to engage the fastener disposed behind the leading fastener within the collated strip of fasteners, and for de-energizing said linearly movable push-type solenoid means, after a predetermined period of time, so as to permit said spring-biased means to move said fastener-advancement feed pawl in a forward extended direction, under the influence of the biasing force of said spring-biased means, so as to advance the leading fastener of the collated strip of fasteners into the driving channel of the fastener-driving tool.

8. The fastener-advancement system as set forth in claim 6, wherein said electro-mechanical system comprises:

a fastener-advancement feed pawl;

spring-biased means operatively engaged with said fastener-advancement feed pawl for biasing said fastener-advancement feed pawl in a forward, fastener-advancement direction;

rotary-type solenoid means operatively connected to said spring-biased means; and timing circuit means operatively connected to said rotary-type solenoid means for energizing said rotary-type solenoid means so as to cause said spring-biased means to move said fastener-advancement feed pawl in a rearward retracted direction, against the biasing force of said spring-biased means, when said driver blade moves from said forward extended position toward said rearward retracted position, so as to engage the fastener disposed behind the leading fastener within the collated strip of fasteners, and for de-energizing said rotary-type solenoid means, after a predetermined period of time, so as to permit said spring-biased means to move said fastener-advancement feed pawl in a forward extended direction, under the influence of the biasing force of said spring-biased means, so as to advance the leading fastener of the collated strip of fasteners into the driving channel of the fastener-driving tool.

9. The fastener-advancement system as set forth in claim 6, wherein said electro-mechanical system comprises:

a fastener-advancement feed pawl;

spring-biased means operatively engaged with said fastener-advancement feed pawl for biasing said fastener-advancement feed pawl in a forward, fastener-advancement direction;

a linearly movable pull-type solenoid means operatively connected to said spring-biased means; and timing circuit means operatively connected to said linearly movable pull-type solenoid means for energizing said linearly movable pull-type solenoid means so as to cause said spring-biased means to move said fastener-advancement feed pawl in a rearward retracted direction, against the biasing force of said spring-biased means, when said driver blade moves from said forward extended position toward said rear-ward retracted position, so as to engage the fastener disposed behind the leading fastener within the collated strip of fasteners, and for de-energizing said linearly movable pull-type solenoid means, after a predetermined period of time, so as to permit said spring-biased means to move said fastener-advancement feed pawl in a forward extended direction, under the influence of the biasing force of said spring-biased means, so as to advance the leading fastener of the collated strip of fasteners into the driving channel of the fastener-driving tool.

10. The fastener-advancement system as set forth in claim 9, further comprising:

a work contact element; and cam means operatively interconnecting said work contact element with said spring-biased means for initially moving said spring-biased means and said fastener-advancement feed pawl a predetermined distance in said rearward retracted direction so as to minimize the power requirements of said linearly movable pull-type solenoid means when said linearly movable pull-type solenoid means is energized so as to move said fastener-advancement feed pawl in said rearward retracted direction to its position behind the leading fastener within the collated strip of fasteners.

11. A fastener-driving tool, comprising:

a driving channel through which a fastener is to be driven so as to be discharged outwardly from said fastener-driving tool;

driving means, reciprocally mounted within said driving channel of said fastener-driving tool for movement between a rearward retracted position and a forward extended position, for driving a leading fastener, of a collated strip of fasteners, through said driving channel, and for discharging the leading fastener of the collated strip of fasteners out from said fastener-driving tool; and means, operatively connected to said driving means and movable in response to rearward movement of said driving means, for separating the leading fastener of the collated strip of fasteners from the remaining fasteners of the collated strip of fasteners, and for advancing the leading fastener of the collated strip of fasteners into said driving channel of said fastener-driving tool, when said driving means is substantially disposed at said rearward retracted position so as to predispose the leading fastener of the collated strip of fasteners within said driving channel of said fastener-driving tool in preparation for the driving and discharging of the leading fastener of the collated strip of fasteners through said driving channel of said fastener-driving tool and out from said fastener-driving tool by said driving means when said driving means is moved from said rearward retracted position toward said forward extended position.

12. The fastener-driving tool as set forth in claim 11, wherein:

said driving means comprises a driver blade.

13. The fastener-driving tool as set forth in claim 12, wherein:

said means, operatively connected to said driver blade, for separating the leading fastener of the collated strip of fasteners from the remaining fasteners of the collated strip of fasteners, and for advancing the leading fastener of the collated strip of fasteners into said driving channel of said fastener-driving tool, comprises a mechanical system operatively engageable with said driver blade.

14. The fastener-driving tool as set forth in claim 13, wherein said mechanical system comprises:

a fastener-advancement feed pawl;

spring means operatively engaged with said fastener-advancement feed pawl for biasing said fastener-advancement feed pawl in a forward, fastener-advancement direction;

a linkage bar operatively connected at a first end portion thereof to said fastener-advancement feed pawl; and a trip lever operatively connected at a first end portion thereof to a second end portion of said linkage bar, and operatively connected at a second end portion thereof to said driver blade such that when said driver blade moves from said forward extended position toward said rearward retracted position, a portion of said driver blade will engage said trip lever so as to cause said trip lever to move said linkage bar so as to, in turn, cause said linkage bar to move said fastener-advancement feed pawl in a rearward retracted direction, against the biasing force of said spring means, so as to engage the fastener disposed behind the leading fastener within the collated strip of fasteners, and when said portion of said driver blade bypasses said trip lever, said biasing force of said spring means will cause said fastener-advancement feed pawl to move in a forward extended direction so as to advance the leading fastener of the collated strip of fasteners into said driving channel of said fastener-driving tool.

15. The fastener-driving tool as set forth in claim 14, wherein:

said trip lever and said linkage bar are pivotally mounted within said fastener-driving tool; and said portion of said driver blade for engaging said trip lever comprises a trip pawl member pivotally mounted up-on said driver blade.

16. The fastener-driving tool as set forth in claim 12, wherein:

said means, operatively connected to said driver blade, for separating the leading fastener of the collated strip of fasteners from the remaining fasteners of the collated strip of fasteners, and for advancing the leading fastener of the collated strip of fasteners into said driving channel of said fastener-driving tool, comprises an electro-mechanical system operatively engageable with said driver blade.

17. The fastener-driving tool as set forth in claim 16, wherein said electro-mechanical system comprises:

a fastener-advancement feed pawl;

spring-biased means operatively engaged with said fastener-advancement feed pawl for biasing said fastener-advancement feed pawl in a forward, fastener-advancement direction;

a linearly movable push-type solenoid means operatively connected to said spring-biased means; and timing circuit means operatively connected to said linearly movable push-type solenoid means for energizing said linearly movable push-type solenoid means so as to cause said spring-biased means to move said fastener-advancement feed pawl in a rearward retracted direction, against the biasing force of said spring-biased means, when said driver blade moves from said forward extended position toward said rear-ward retracted position, so as to engage the fastener disposed behind the leading fastener within the collated strip of fasteners, and for de-energizing said linearly movable push-type solenoid means, after a predetermined period of time, so as to permit said spring-biased means to move said fastener-advancement feed pawl in a forward extended direction, under the influence of the biasing force of said spring-biased means, so as to advance the leading fastener of the collated strip of fasteners into said driving channel of said fastener-driving tool.

18. The fastener-driving tool as set forth in claim 16, wherein said electro-mechanical system comprises:

a fastener-advancement feed pawl;

spring-biased means operatively engaged with said fastener-advancement feed pawl for biasing said fastener-advancement feed pawl in a forward, fastener-advancement direction;

rotary-type solenoid means operatively connected to said spring-biased means; and timing circuit means operatively connected to said rotary-type solenoid means for energizing said rotary-type solenoid means so as to cause said spring-biased means to move said fastener-advancement feed pawl in a rearward retracted direction, against the biasing force of said spring-biased means, when said driver blade moves from said forward extended position toward said rearward retracted position, so as to engage the fastener disposed behind the leading fastener within the collated strip of fasteners, and for de-energizing said rotary-type solenoid means, after a predetermined period of time, so as to permit said spring-biased means to move said fastener-advancement feed pawl in a forward extended direction, under the influence of the biasing force of said spring-biased means, so as to advance the leading fastener of the collated strip of fasteners into said driving channel of said fastener-driving tool.

19. The fastener-driving tool as set forth in claim 16, wherein said electro-mechanical system comprises:

a fastener-advancement feed pawl;

spring-biased means operatively engaged with said fastener-advancement feed pawl for biasing said fastener-advancement feed pawl in a forward, fastener-advancement direction;

a linearly movable pull-type solenoid means operatively connected to said spring-biased means; and timing circuit means operatively connected to said linearly movable pull-type solenoid means for energizing said linearly movable pull-type solenoid means so as to cause said spring-biased means to move said fastener-advancement feed pawl in a rearward retracted direction, against the biasing force of said spring-biased means, when said driver blade moves from said forward extended position toward said rear-ward retracted position, so as to engage the fastener disposed behind the leading fastener within the collated strip of fasteners, and for de-energizing said linearly movable pull-type solenoid means, after a predetermined period of time, so as to permit said spring-biased means to move said fastener-advancement feed pawl in a forward extended direction, under the influence of the biasing force of said spring-biased means, so as to advance the leading fastener of the collated strip of fasteners into said driving channel of said fastener-driving tool.

20. The fastener-driving tool as set forth in claim 19, further comprising:

a work contact element; and cam means operatively interconnecting said work contact element with said spring-biased means for initially moving said spring-biased means and said fastener-advancement feed pawl a predetermined distance in said rearward retracted direction so as to minimize the power requirements of said linearly movable pull-type solenoid means when said linearly movable pull-type solenoid means is energized so as to move said fastener-advancement feed pawl in said rearward retracted direction to its position behind the leading fastener within the collated strip of fasteners.

* * * * *